US009321083B2

(12) United States Patent
Volta et al.

(10) Patent No.: US 9,321,083 B2
(45) Date of Patent: Apr. 26, 2016

(54) METHOD OF SORTING MAILPIECES USING A SORTING FRAME, WITH A VIRTUAL STACK OF MAILPIECE IMAGES BEING DISPLAYED

(71) Applicant: SOLYSTIC, Bagneux (FR)

(72) Inventors: Bruno Volta, Gif sur Yvette (FR); Emmanuel Miette, Saint Gratien (FR)

(73) Assignee: SOLYSTIC, Bagneux (FR)

( * ) Notice: Subject to any disclaimer, the term of this patent is extended or adjusted under 35 U.S.C. 154(b) by 16 days.

(21) Appl. No.: 14/368,973

(22) PCT Filed: May 15, 2014

(86) PCT No.: PCT/FR2014/051130
§ 371 (c)(1),
(2) Date: Jun. 26, 2014

(87) PCT Pub. No.: WO2015/001206
PCT Pub. Date: Jan. 8, 2015

(65) Prior Publication Data

US 2015/0117702 A1 Apr. 30, 2015

(30) Foreign Application Priority Data

Jul. 4, 2013 (FR) ..... 13 56553

(51) Int. Cl.
*B07C 7/00* (2006.01)
*B07C 3/20* (2006.01)

(52) U.S. Cl.
CPC .. *B07C 7/005* (2013.01); *B07C 3/20* (2013.01)

(58) Field of Classification Search
None
See application file for complete search history.

(56) References Cited

U.S. PATENT DOCUMENTS 6,370,446 B1 * 4/2002 Divine ..... B07C 3/00 700/223
6,587,572 B1 * 7/2003 Suchenwirth-Bauersachs ..... B07C 3/20 209/584
6,786,404 B1 * 9/2004 Bonner ..... B07C 3/00 235/383
8,027,511 B2 * 9/2011 Philip ..... G07B 17/00661 209/584
2006/0253406 A1 * 11/2006 Caillon ..... B07C 3/00 705/410
2007/0000818 A1 * 1/2007 Delitz ..... G06Q 10/087 209/534
2007/0000989 A1 * 1/2007 Kadaba ..... B07C 3/008 235/375
2010/0318215 A1 * 12/2010 Bentele ..... B07C 7/005 700/215
2014/0354686 A1 * 12/2014 Mullins ..... G06T 19/006 345/633

FOREIGN PATENT DOCUMENTS

EP 2 260 952 A1 12/2010

* cited by examiner

*Primary Examiner* — Jon Chang
(74) *Attorney, Agent, or Firm* — Ware, Fressola, Maguire & Barber LLP

(57) ABSTRACT

A method of sorting mailpieces into a sorting frame having sorting slots where, in a sorting pass, and in a memory of a monitoring/control unit with a display screen, recording digital images of mailpieces to be sorted, each image including a delivery address; on the basis of each digital image of a mailpiece, generating a sorting code identifying a sorting slot of the sorting frame, and, in the memory, organizing the mailpieces into virtual stacks of images, each virtual stack of images corresponding to a stack of mailpieces placed in a stack in a sorting slot of the sorting frame and the images in each virtual stack of images being sequenced in the same order as the mailpieces in said stack of mailpieces; and in a subsequent sorting pass, displaying on the screen the images and a sorting code of said mailpieces organized in a virtual stack.

7 Claims, 3 Drawing Sheets

METHOD OF SORTING MAILPIECES USING A SORTING FRAME, WITH A VIRTUAL STACK OF MAILPIECE IMAGES BEING DISPLAYED

CROSS REFERENCE TO RELATED APPLICATIONS

This application is the U.S. National Stage of International Application Number PCT/FR2014/051130 filed on May 15, 2014 which application claims priority under 35 USC §119 to French Patent Application No. 1356553 filed on Jul. 4, 2013, which applications are hereby incorporated by reference in their entirety.

TECHNICAL FIELD

The invention relates to the field of postal sorting and more particularly to the field of manually sorting mailpieces into a sorting frame in a plurality of sorting passes, it being possible for the mailpieces to be flat articles such as letters or magazines, or to be parcels, etc.

PRIOR ART

Sorting mailpieces into sorting frames has been in existence for a long time, in particular in post offices that deliver mail. Ordinarily, the sorting is done manually by an experienced operator who firstly puts the mailpieces to be sorted in a container, and then takes the mailpieces one-by-one from the container, reads the destination address of each mailpiece as it is taken, and places it in a sorting slot of the sorting frame, which slot corresponds to said destination address. The sorting frame that is generally placed on a desk in front of the operator may have its sorting slots aligned in rows and columns in a two-dimensional matrix configuration. A sorting frame may include several tens of sorting slots.

Once the sorting is finished, the sorted mailpieces can be retrieved directly from the sorting slots of the sorting frame in sequenced manner, e.g. for preparing a delivery round or "postman's walk".

Since the number of mailpieces to be handled is increasing, it is common to need to perform a plurality of sorting passes in order to sort mail into delivery rounds. However, such sorting passes require a lot of time, leading postal authorities to seek systems for assisting with manual sorting into sorting frames in order to accelerate manual sorting into sorting frames and in order to render such sorting more reliable.

SUMMARY OF THE INVENTION

An object of the invention is to improve the sorting of mailpieces into sorting frames.

To this end, the invention provides a method of sorting mailpieces into a sorting frame having sorting slots, the method being characterized in that it comprises the following steps:

a) in a sorting pass, and in a memory of a monitoring/control unit with a display screen, recording digital images of the mailpieces to be sorted, each image including a delivery address;

b) on the basis of each digital image of a mailpiece to be sorted, generating a sorting code identifying a sorting slot of the sorting frame, and, in the memory, organizing the mailpieces into virtual stacks of images, each virtual stack of images corresponding to a stack of mailpieces placed in a stack in a sorting slot of the sorting frame and the images in each virtual stack of images being sequenced in the same order as the mailpieces in said stack of mailpieces; and c) in a subsequent sorting pass, for sorting a stack of mailpieces into a sorting frame, displaying on the screen the images of said mailpieces organized in a virtual stack and with, in each image, a sorting code embedded in the image.

The basic idea of the invention is thus to give assistance to the operator that is based on displaying stacks of virtual images of the mailpieces to be sorted into a sorting frame, in particular in a second sorting pass, and for any subsequent other sorting pass. Each virtual stack of images is a sort of graphical representation (in reality a virtual representation) of a stack of mailpieces to be sorted by the operator. A sorting code is embedded in each image, which sorting code is computed by the monitoring/control unit as a function of the current sorting plan, and identifies, in a manner legible by the operator, that sorting slot of the sorting frame into which the corresponding mailpiece should be placed. It should be understood that, at the end of a sorting pass, the sorting slots of the sorting frame contain stacks of sorted and sequenced mailpieces. The virtual stacks of images correspond to said stacks of sorted and sequenced mailpieces in respective ones of the sorting slots of the sorting frame. On the display screen, each virtual stack of images can be thumbed through and the images of the stack can be unstacked virtually as the operator is placing a corresponding mailpiece in the sorting slot of the sorting frame that corresponds to the sorting code embedded in the virtually unstacked image, thereby making it possible to increase the sorting rate of the operator and to reduce the sorting errors in the sorting of the mailpieces into a sorting frame.

In accordance with a feature of the method of the invention, at the end of a sorting pass for sorting mailpieces into a sorting frame, separators are placed in the sorting slots of the sorting frame. The separators serve to identify to the monitoring/control unit the virtual stack of images to be presented on the display screen, thereby obviating the need to identify the mailpieces using bar codes or image signatures.

BRIEF DESCRIPTION OF THE DRAWINGS

The present invention can be better understood and other advantages appear on reading the following detailed description of an implementation given by way of non-limiting example and with reference to the accompanying drawings, in which.

DESCRIPTION OF IMPLEMENTATIONS

The method of the invention for sorting mailpieces into a sorting frame is particularly well suited to sorting mailpieces into a sorting frame in a sorting center, in a delivery office, or in a post and delivery office, for sorting them into delivery rounds or "postman's walks".

For reasons of simplicity, an implementation of the method of the invention is described below with the mailpieces being sorted into a sorting frame in two sorting passes, but naturally the method of the invention is applicable to sorting in three or more sorting passes. It is also applicable to sorting mailpieces that have already undergone a first sorting pass in an automatic sorting machine having a sorting conveyor.

Figure 1:
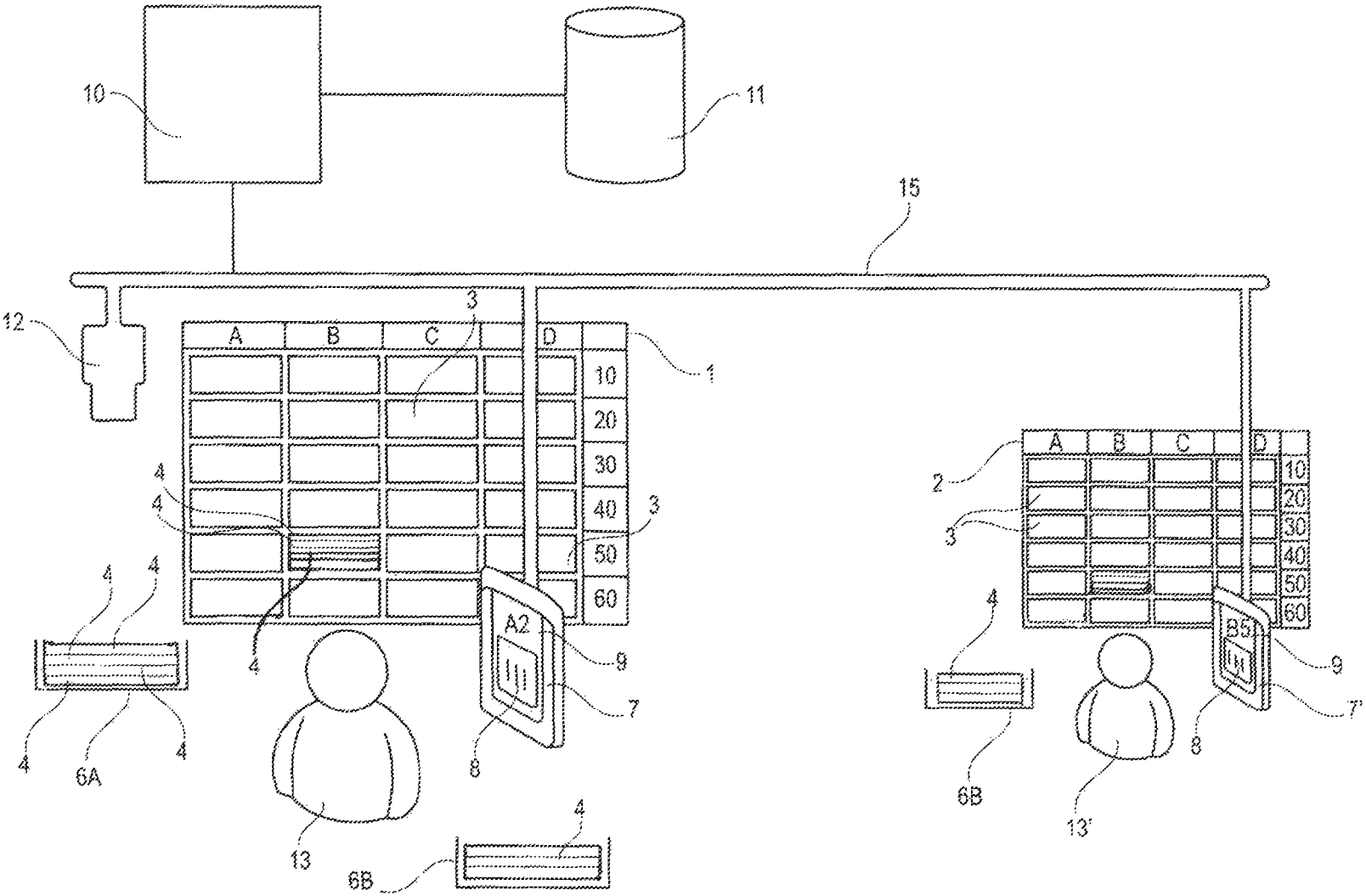
FIG. 1 shows a method of the invention for sorting mailpieces into a sorting frame.

FIG. 1 is a highly diagrammatic view of sorting equipment that, in this example, comprises two sorting frames for sorting in two passes with two operators, each operator performing a single sorting pass on the mailpieces to be sorted. Naturally, the method of the invention is applicable even when the same operator performs the sorting in two passes on the same sorting frame.

In particular, FIG. 1 shows a first sorting frame 1 and a second sorting frame 2, each of which is provided with a plurality of sorting slots 3 disposed in a plurality of rows. In this configuration, the first sorting frame 1 serves to enable operator 13 to sort the mailpieces 4 in a first sorting pass, and the second sorting frame 2 serves to enable the other operator 13' to sort the mailpieces as sorted in the first sorting pass in a second sorting pass, e.g. for manual delivery.

Each sorting slot 3 of a sorting frame is dimensioned to be filled with a certain number of mailpieces 4 stacked flat one above another as shown in FIG. 1 in slot B50, e.g. a stack of a few tens of letters.

The mailpieces 4 to be sorted in the first sorting pass may, in this example, arrive in a storage tray 6A or in a plurality of storage trays 6A. In this example, it is assumed that they are disposed in a stack and in flat manner in each storage tray 6A.

For implementing the method of the invention, respective display screens 7, 7' are used next to sorting frame 1 and next to sorting frame 2, which screens are suitable for displaying digital images 8 of the mailpieces 4. In accordance with the invention, said images are organized in a virtual stack of images as described below, with a sorting code 9 being embedded in each image displayed on the screen and identifying a sorting slot of sorting frame 1 or of sorting frame 2.

The sorting screen(s) 7 and 7' are connected to a monitoring/control unit 10 of the programmable data processing unit type that uses a database 11 that stores data on the mailpieces to be sorted, the images of the mailpieces, and the sorting plans for sorting the mailpieces into sorting frames (i.e. the associations between the delivery addresses of the mailpieces and the sorting slots of the sorting frames for each sorting pass).

In the method of the invention, it is also possible to use a camera 12 connected to the unit 10 and that serves to form a digital image of each mailpiece in the first sorting pass. However, such digital images may have been formed during a first pass in a sorting machine with a sorting conveyor that is known per se, as indicated above. In the example, the camera 12 is placed on the left of sorting frame 1 and above the mailpieces stacked in the tray 6A also situated on the left of sorting frame 1. In practice, the mailpieces 4 in the storage tray 6A are stored in a stack and in flat manner, with the recipient address facing upwards in such a manner as to be visible to the camera 12. The camera 12 may be designed to form digital images of the top of the stack automatically and at a certain rate, e.g. it may be designed to form four digital images per second in such a manner as to keep pace with the unstacking of the mailpieces during the sorting. It is placed at an appropriate distance from the storage tray 6A, e.g. at a distance enabling it to have the entire height of the stack of mailpieces within its depth of field, thereby enabling a sharp digital image to be obtained of each mailpiece as operator 13 takes the mailpiece from the top of the stack so as to place it in one of the sorting slots 3 of sorting frame 1.

The monitoring/control unit 10 is arranged such that, from a digital image generated by the camera 12, said monitoring/control unit automatically evaluates a recipient address of the corresponding mailpiece, via an optical character recognition (OCR) system and via a postal destination address database, as is well known to the person skilled in the art. It can thus be understood that, on the basis of a digital image 8 of a mailpiece 4 generated by the camera 12, the unit 10 is suitable for determining a delivery postal address, for recording the image and the delivery postal address data in a memory in the database 11, and also, on the basis of a sorting plan stored in a memory in the unit 10, for generating a sorting code that, in this example, identifies a certain sorting slot 3 of sorting frame 1 (or also a slot 3 of frame 2) in which slot the corresponding mailpiece should be placed by the operator 13 or 13'.

It can be understood that the camera 12, the screen(s) 7 and 7', and the unit 10 communicate via a communications network 15 that may be a wired network or a wireless network.

In order to facilitate understanding of the method of the invention, in FIG. 1, each sorting slot of a sorting frame is referenced with a sorting code including a letter A, B, C, D, etc. that designates a column of the sorting frame, and a number 10, 20, 30, etc. that designates a row of the sorting frame.

Figure 2:
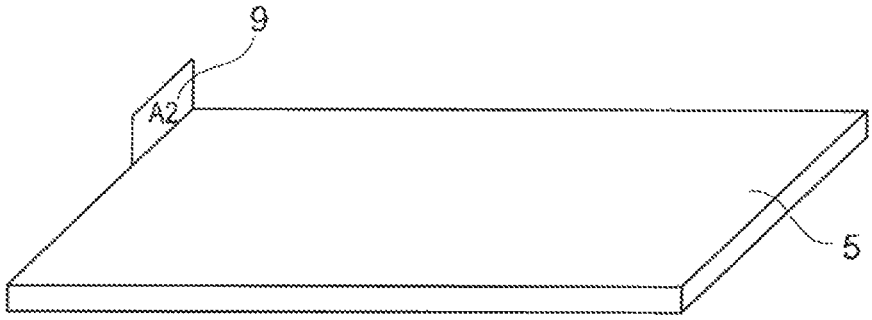
FIG. 2 shows a separator that is used in the method of the invention.

In the method of the invention, separators 5 are also used, one of which is shown in FIG. 2. Each separator is provided with a sorting code identifying a sorting slot 3 in a manner that is legible for the operator. In this way, at the end of each sorting pass, the operator can place a separator 5 in each corresponding sorting slot of the sorting frame. For example, in FIG. 2, the separator 5 bears marking that identifies the sorting slot A2 using the same codification for the sorting slots 3 as indicated above. Such marking may be placed on an edge of the separator 5 so as to be clearly visible to the operator. It is thus possible to have as many separators 5 as there are sorting passes 3 in a sorting frame for implementing the method of the invention.

Figure 4:
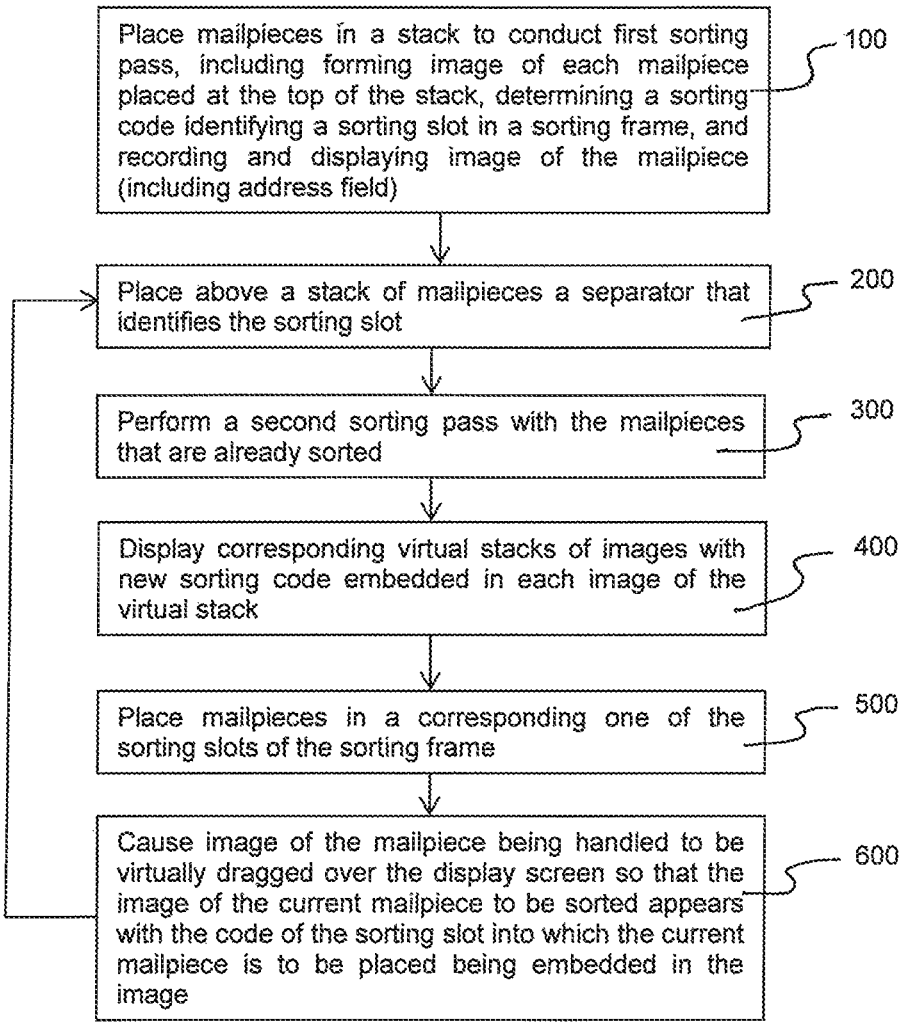
FIG. 4 is a flow chart showing the main steps of the method of the invention for sorting mailpieces into a sorting frame.

FIG. 4 shows the main steps of the method of the invention. In step 100, mailpieces 4 to be sorted are placed in a stack and as flat in a tray 6A situated on the left of the sorting frame 1. The camera 12 forms an image 8 of the mailpiece 4 placed at the top of the stack of mailpieces 4. The unit 10 recognizes the delivery address in the image, determines a sorting code identifying a sorting slot of sorting frame 1 on the basis of the sorting plan for the sorting in the first pass, records the image 8 of the mailpiece and the address data and sorting data in a memory, and displays the image 8 of the mailpiece on the screen 7 with the corresponding sorting code (A2 in this example) being embedded in said image. By viewing the sorting code on the image displayed on the screen, operator 13 is thus assisted with placing the mailpiece 4 from the top of the stack in the corresponding slot in the frame 1. The sorting process is repeated in this way for all of the mailpieces 4 to be sorted in the first sorting pass.

At the end of the first sorting pass, the mailpieces 4 are distributed in stacks of mailpieces in the sorting slots 3 of the sorting frame 1 as shown in slot B50 in FIG. 1. It should be noted that the unit 10 may filter out the images 8 that are not pertinent, e.g. by comparing two successive images 8 taken by the camera 12. For comparing two successive images 8, it is also possible to use comparison of the image signatures.

Figure 3:
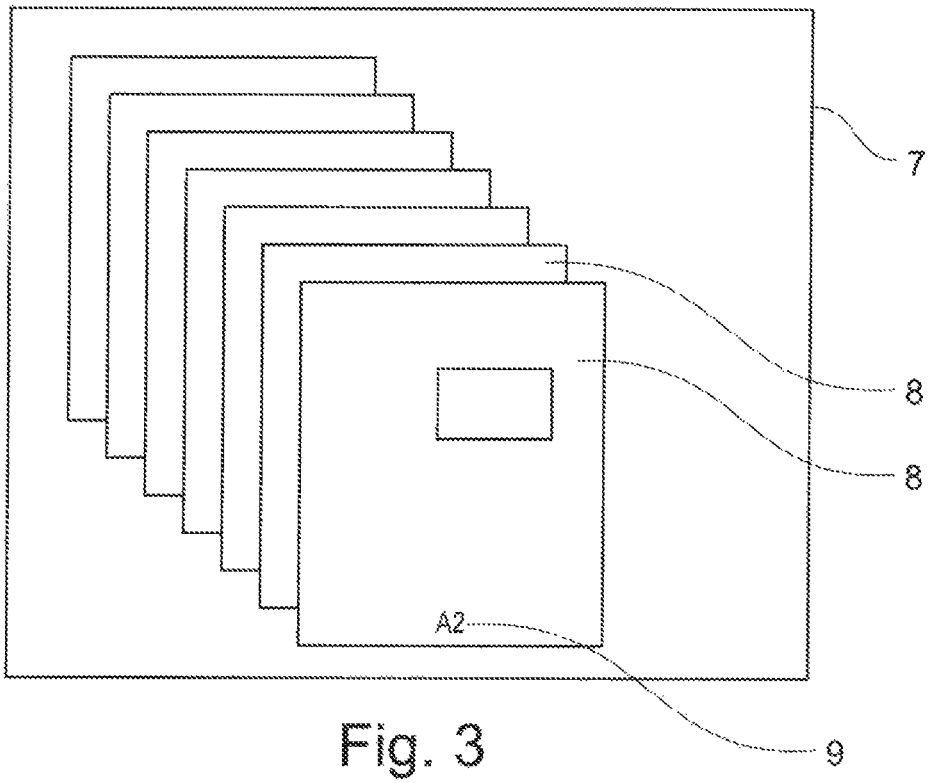
FIG. 3 shows a virtual stack of images that are displayed on a display screen for assisting with sorting of the invention for sorting mailpieces into a sorting frame.

In accordance with the invention, in a memory in the database 11, the unit 10 organizes the images 8 of the mailpieces 4 into virtual stacks of images, as shown in FIG. 3. Each virtual stack of images 8 is associated with a sorting slot identifier, which, in this example, is a code with a letter and a number, e.g. A2. Each virtual stack of images 8 corresponds to a stack of sorted and sequenced mailpieces in a sorting slot of the sorting frame 1, e.g. slot A2, and the images 8 in each virtual stack are sequenced in the same order as the mailpieces in the corresponding stack of mailpieces 4 that has been formed in a sorting slot of the sorting frame 1.

In step 200 in FIG. 4, in each sorting slot 3 of the sorting frame 1, the operator 13 places above a stack of mailpieces 4 a separator 5 that identifies the sorting slot in question. Then the operator 13 empties the sorting frame 1, slot by slot, and, for example, puts each stack of mailpieces 4 with the separator 5 coming from the same sorting slot in a storage tray 6B that is then brought to the other operator 13' on the right in FIG. 2. Thus, after emptying the sorting frame 1, a series of stacks of mailpieces that have been sorted in a first pass are obtained, each stack of mailpieces 4 also being identified by a separator 5 that itself identifies the sorting slot of the sorting frame 1 from which the stack of mailpieces comes. In addition, stored in a memory in the unit 10, are sequenced virtual stacks of images 8, each of which stacks is identified by a sorting slot code and corresponds to a respective one of the stacks of mailpieces 4 extracted from the sorting frame 1.

In step 300, the operator 13' on the right of FIG. 1 performs the second sorting pass with the mailpieces 4 that are already sorted and that are in stacks in the trays 6B. For this purpose, operator 13' reads the sorting slot identifier on the separator 5 associated with the stack and enters said identifier into the unit 10 by inputting it on a keyboard or by using any other equivalent input means. In response, on the screen 7', the unit 10 displays the corresponding virtual stack of images 8 with, embedded in each image of the virtual stack, a new sorting code 9 (the code B5 in this example) that identifies the sorting slot in the sorting frame 2 where the corresponding mailpiece is to be placed (step 400 in FIG. 4). Naturally, this new sorting code 9 is computed by the unit 10 on the basis of a second sorting plan for sorting the mailpieces that is stored in a memory in the unit 10 and that, in this example, thus associates the delivery addresses of the mailpieces with the sorting slots 3 of the sorting frame 2. This computation can take place after the sorting frame 1 has been emptied.

In step 500, the operator 13' takes hold of the mailpieces 4 in the tray 6B one by one and places them, every time, in a corresponding one of the sorting slots of the sorting frame 2, and each time a mailpiece is being placed in a sorting slot, said operator 13', in step 600, causes the image of the mailpiece being handled to be dragged virtually over the display screen 7 so that the image of the current mailpiece to be sorted appears with the code of the sorting slot into which said current mailpiece is to be placed being embedded in said image.

FIG. 3 shows a virtual stack of images 8 in a fanned-out configuration that gives the operator a preview of the number of mailpieces to be unstacked. It is understood that the unit 10 can be programmed to make it possible to scroll through the stack of images 8 virtually so as to give further assistance with the manual sorting into the sorting frame.

The sorting process in a second pass continues in this way for each stack of mailpieces sorted in a first pass in the sorting frame 1.

At the end of the second sorting pass, the operator may, for example, start a third sorting pass, into the sorting frame 2. For this purpose, the operator places separators 5 in the full sorting slots of the sorting frame 2, as indicated above, and said operator empties the sorting frame 2 so as to constitute new stacks of mailpieces 4, each of which stacks is identified by a respective separator. In particular, the operator 13' thus enters an identification code of a separator 5 again into the unit 10, which responds by displaying a virtual stack of sequenced images with a new code identifying a respective sorting slot being embedded in each image, thereby enabling the operator 13' to sort the mailpieces again into the sorting slots of the sorting frame 2 in a third sorting pass.

Naturally, the present invention is in no way limited to the above description of one of its implementations, which can undergo modifications without going beyond the ambit of the invention. In particular, the display screen 7 or 7' may be a touch-sensitive screen or indeed a mobile telephone with, for example, a high-definition screen. The method of the invention may also be applied to merging mail. In each image displayed on the screen 7 or 7', the operator must be able to view a destination address so as to check it visually against the destination address on the mailpiece to be sorted in the sorting frame. The method of the invention may be made finer by embedding, in each image, the sorting code associated with the current mailpiece that corresponds to the image, and also, in advance of the sorting, the sorting code of the mailpiece that follows the current mailpiece in the stack of mailpieces to be sorted. Naturally, the sorting code is advantageously embedded in the image of the mailpiece to be sorted while also leaving the destination address visible. But the sorting code may also be presented next to the image of the mailpiece if the display screen has sufficient display dimensions.

What is claimed is:

1. A method of sorting mailpieces into a first sorting frame having sorting slots comprising:

a) in a first sorting pass, and in a memory of a monitoring/control unit with a display screen, recording digital images of the mailpieces to be sorted, each image including a delivery address;

b) on the basis of each digital image of a mailpiece to be sorted, generating a first sorting code identifying a sorting slot of said first sorting frame, and, in the memory, organizing the digital images of the mailpieces into virtual stacks of images, each virtual stack of images corresponding to one stack of mailpieces of a plurality of stacks of mailpieces said one stack of mailpieces placed in a stack in a sorting slot of the sorting frame and the images in each virtual stack of images being sequenced in the same order as the mailpieces in said one stack of mailpieces; and c) in a second sorting pass, sorting at least one of said stacks of mailpieces into a second sorting frame, displaying on the display screen the digital images of said mailpieces organized in any one of said virtual stacks and with, in each image, a second sorting code embedded in the image.

2. The method according to claim 1, wherein at the end of said first sorting pass, separators are placed in the sorting slots of the first sorting frame.

3. The method according to claim 2, wherein at the end of said second sorting pass, separators are placed in the sorting slots of the second sorting frame.

4. The method according to claim 1, wherein at the end of said second sorting pass, separators are placed in the sorting slots of the second sorting frame.

5. The method according to claim 1, wherein the first and second sorting frame are the same sorting frame.

6. The method according to claim 3, wherein at least one more sorting pass is performed after said second sorting pass into said first or second sorting frame.

7. The method according to claim 1, wherein at least one more sorting pass is performed after said second sorting pass into said first or second sorting frame.

* * * * *